United States Patent [19]

Matsuda

[11] 4,392,363

[45] Jul. 12, 1983

[54] SLIDE FASTENER STRINGER WITH VENT HOLES

[75] Inventor: Yoshio Matsuda, Nyuzen, Japan

[73] Assignee: Yoshida Kogyo K. K., Tokyo, Japan

[21] Appl. No.: 178,309

[22] Filed: Aug. 15, 1980

[30] Foreign Application Priority Data

Nov. 27, 1979 [JP] Japan ..... 54-163930[U]

[51] Int. Cl.[3] ..... D04B 23/08

[52] U.S. Cl. ..... 66/193; 24/205.16 R

[58] Field of Search ..... 66/195, 190, 192, 193; 24/205.16 R, 205.15 R, 205.16 C

[56] References Cited

U.S. PATENT DOCUMENTS

| | | | |
|---|---|---|---|
| 4,015,450 | 4/1977 | Matsuda et al. | 66/195 |
| 4,074,543 | 2/1978 | Schmidt | 66/193 |
| 4,125,591 | 11/1978 | Moertel | 5/347 |
| 4,220,182 | 9/1980 | Glindmeyer et al. | 24/205.16 C |
| 4,291,440 | 9/1981 | Yoshida | 24/205.16 R |

FOREIGN PATENT DOCUMENTS

| | | |
|---|---|---|
| 51-135709 | 11/1976 | Japan . |
| 52-24161 | 6/1977 | Japan . |

*Primary Examiner*—Ronald Feldbaum

*Attorney, Agent, or Firm*—Hill, Van Santen, Steadman, Chiara & Simpson

[57] ABSTRACT

A venting slide fastener stringer for use on a cushion, a pillow, etc. has a warp-knit stringer tape including a pair of laterally spaced, elongate webs with a wale-free region therebetween, and a connecting thread or threads having portions laid in opposed marginal wales in the webs and substantially parallel portions extending transversely across the wale-free region to interconnect the webs, thereby providing a plurality of vent holes longitudinally along the wale-free region. The opposed marginal wales are more rigid than other wales in the webs, and the connecting thread or threads are more rigid than foundation threads making up the webs. A row of coupling elements is mounted on one of the webs remotely from the wale-free region.

6 Claims, 4 Drawing Figures

SLIDE FASTENER STRINGER WITH VENT HOLES

BACKGROUND OF THE INVENTION

1. Field of the Invention

The present invention relates to a venting slide fastener stringer for being attached to cushions, pillows, mats, etc. which require venting.

2. Prior Art

There have heretofore been known a variety of venting slide fasteners having vent holes in the fastener stringer tapes. One such slide fastener disclosed in U. S. Pat. No. 4,125,911, patented Nov. 21, 1978, includes a plurality of vent holes punched in stringer tapes of polymer film material as shown in FIG. 4 of the accompanying drawings. When the slide fastener is transversely stretched in response to a lateral pull, the tapes shrink longitudinally and hence get puckered or wavy, which condition causes the interdigitating rows of coupling elements are also to become undulated, thereby making a slider sluggish during the movement therealong to open or close the slide fastener. Garments with such slide fasteners attached are also subjected to puckering under the influence of shrinkage of the tapes. The slide fastener thus stretched is unsightly and has insufficient venting capability due to deformed vent holes. Woven and knitted slide fasteners having vents are shown, for example, in Japanese Utility Model Publications Nos. 51-135709 and 52-24161 published Nov. 2, 1976 and June 1, 1977, respectively.

SUMMARY OF THE INVENTION

A venting slide fastener stringer has a warp-knit stringer tape including a pair of laterally spaced, elongate webs and a wale-free region between the webs, the webs being interconnectedby a connecting thread or threads running across the wale-free region. The connecting thread or threads have portions laid in opposed marginal wales in the webs and substantially parallel portions extending transversely across the wale-free region between the webs in a direction substantially perpendicular to the marginal wales, thereby providing a plurality of vent holes longitudinally along the wale-free region. The opposed marginal wales are more rigid than other wales in the webs, and the connecting thread or threads are more rigid than foundation threads that the webs are knitted of.

It is an object of the present invention to provide a slide fastener stringer with vent holes which is structurally strong against deformation in response to a lateral pull.

Another object of the present invention is to provide a slide fastener stringer with vent holes which substantially resists any lateral stretching.

Still another object of the present invention is to provide a venting slide fastener stringer of a warp-knit structure having a plurality of vents that are resistant to shifting or deformation when subjected to a lateral pull.

Still another object of the present invention is to provide a venting slide fastener stringer having sufficient venting capability at all times.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
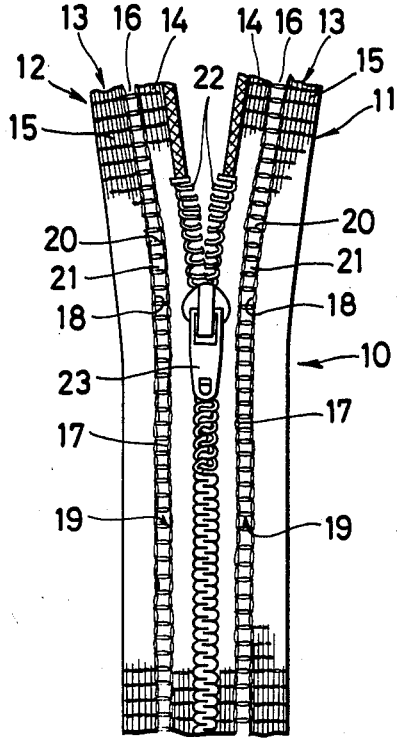
FIG. 1 is a fragmentary front elevational view of a venting slide fastener including a pair of slide fastener stringers according to the present invention.
Figure 4:
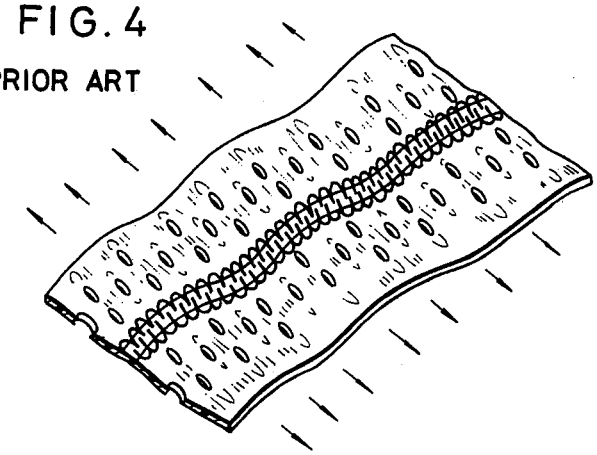
FIG. 4 PRIOR ART
FIG. 4, appearing with FIG. 1, is a fragmentary perspective view of a conventional slide fastener.

The principles of the present invention are particularly useful when embodied in a venting slide fastener such as shown in FIG. 1, generally indicated by the numeral 10. The venting slide fastener 10 comprises a pair of slide fastener stringers 11, 12 each including a warp-knit stringer tape 13 having a pair of longitudinally extending, parallel warp-knit webs 14, 15 for supporting coupling elements and for being attached to a garment, respectively, and a longitudinal wale-free region 16 interposed between the webs 14, 15. The warp-knit webs 14, 15 include a pair of confronting marginal wales 17, 18 interconnected transversely by a connecting thread 19 having ladder-like parallel portions 20 extending transversely across the wale-free region 16 in a direction substantially perpendicular to the marginal wales 17, 18, thereby providing a plurality of substiantially square vent holes 21 longitudinally along the wale-free region 16.

The slide fastener stringers 11, 12 also include a pair of rows of coupling elements 22, 22, respectively, each in the form of a helically coiled monofilament, which are mounted on inner confronting beaded edges of the stringer tapes 13, 13. The slide fastener can be opened and closed by a slider 23 movable along the rows of coupling elements 22, 22 to take them into and out of interdigitating engagement with each other.

Figure 2:
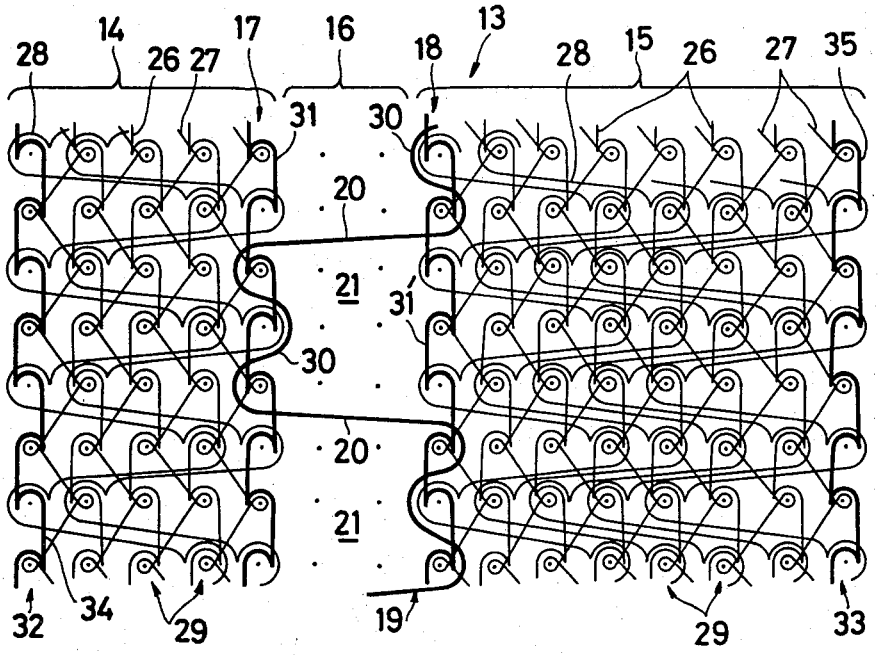
FIG. 2 is a diagram showing lapping movements for a warp-knit stringer tape according to an embodiment.

As shown in FIG. 2, each of the warp-knit webs 14, 15 is composed of a first group of foundation threads 26 knitted as chain stitches in a pattern of 1–0/0–1, a second group of foundation threads 27 knitted as tricot stitches in a pattern of 1–2/1–0, and a third group of foundation threads 28 knitted in a pattern of 0–1/4–3, the foundation threads 26, 27, 28 thus knitted constituting a plurality of longitudinal wales 29 juxtaposed across the web 14, 15. The wale-free region 16 is devoid of two wales. The connecting thread 19 is laid across the wale-free region 16 in a pattern of 0–0/1–1/0–0/-4–4/3–3/4–4 so that the connecting thread 19 also includes portions 30 laid longitudinally only in the marginal wales 17, 18 and cooperating with the parallel portions 20 to connect the wales 17, 18 together.

The confronting marginal wales 17, 18 comprise in part threads 31, 31', respectively, knitted as chain stitches in a pattern of 1–0/0–1. The threads 31, 31' are thicker than the foundation threads 26, 27, 28 so that the marginal wales 17, 18 are more rigid than the wales 29 in the webs 14, 15. However, the threads 31, 31' may be made of a plurality of paralleled yarns each having the same thickness as that of the threads 26, 27, 28. Outermost wales 32, 33 in the webs 14, 15 are also composed in part of threads 34, 35, respectively, which are thicker than the threads 26, 27, 28. However, of the outermost wales 32, 33, only the wale 32 in the element-supporting web 14 may be composed in part of the thread 34.

The connecting thread 19 may be made of twisted yarns (for example, of 500 denier) which are several times thicker than the threads 26, 27, 28, or of paralleled yarns each having the same thickness as that of the threads 26, 27, 28.

Figure 3:
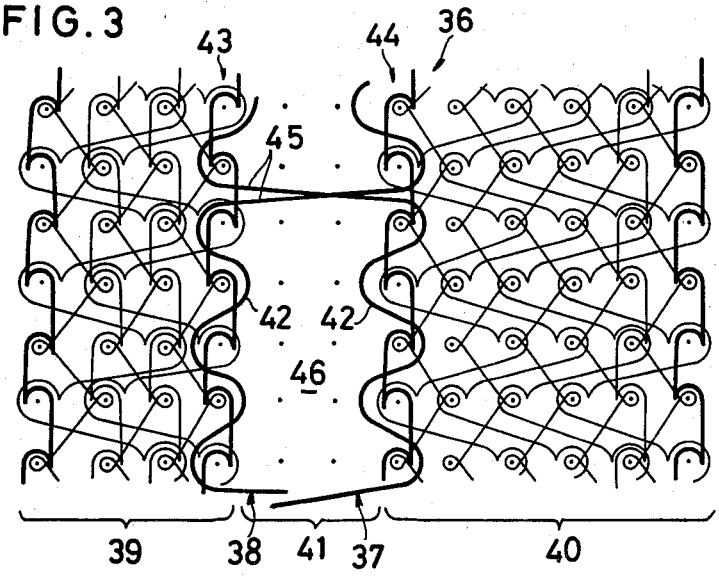
FIG. 3 is a diagram showing lapping movements for a warp-knit stringer tape according to another embodiment.

A warp-knit stringer tape 36 (FIG. 3) constructed according to another embodiment is substantially the same as the stringer tape 13 illustrated in FIG. 2 except that two connecting threads 37, 38 are laid across a wale-free region 41 in symmetrical patterns of 0–0/-1–1/0–0/1–1/0–0/4–4/3–3/4–4/3–3/4–4 and 4–4/3–3/-4–4/3–3/4–4/0–0/1–1/0–0/1–1/0–0, respectively, and one of the webs 40 which is to be attached to a garment is devoid of some threads constituting chain stitches. Each of the connecting threads 37, 38 has portions 42 laid in confronting wales 43, 44 and substantially parallel portions 45 spaced longitudinally of and extending transversely across the wale-free region 41 in a direction substantially perpendicular to the wales 43, 44, thereby defining a plurality of longitudinally arranged rectangular vent holes 46. With several chain stitches thus omitted, the web 40 is relatively flexible to take up stresses applied and hence prevent the vent holes 46 from becoming deformed or otherwise adversely affected by such stresses.

With the arrangement according to the present invention, a lateral pull applied across the slide fastener 10 is borne at the wale-free region 16, 41 by the parallel portions 20, 45 of the connecting thread 19, 37, 38 which run transversely across the wale-free region 16, 41 in a direction substantially perpendicular to the wales 17, 18, 43, 44. Accordingly, the slide fastener 10 is resistant to being transversely stretched or deformed in response to lateral stresses, and hence is free from shrinking longitudinally and becoming wavy or puckered in the longitudinal direction. Since the vent holes 21, 46 are defined by the lateral thread portions 20, 45 of the connecting thread 19, 37, 38 and the rigid wales 17, 18, 43, 44, they are relatively dimensionally stable and resist becoming deformed, thereby providing reliable venting operation when subjected to a lateral pull. Furthermore, the connecting thread 19, 37, 38 is interlaced only with the marginal wales 17, 18, 43, 44 and are structurally independent of the webs 14, 15, 39, 40, with the result that the vent holes 21, 46 are less adversely affected dimensionally by the webs 14, 15, 39, 40. Preferably, each of the holes 21, 46 has substantially a size ranging from 0.5 mm×0.5 mm to 1 mm×1 mm and a size ranging from 0.5 mm×1 mm×2 mm, respectively.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. A venting slide fastener stringer comprising:

(a) a warp-knit stringer tape including a pair of longitudinal warp-knit webs spaced transversely from each other, with a longitudinal wale-free region therebetween, and having a pair of marginal wales, respectively, confronting each other across said wale-free region, and a connecting thread having portions laid only in said marginal wales and substantially parallel adjacent portions all spaced longitudinally of and extending transversely across said wale-free region in a direction substantially perpendicular to said marginal wales, thereby defining a plurality of substantially rectangular vent holes longitudinally along said wale-free region, each of said webs comprising foundation threads constituting a plurality of wales juxtaposed across said each web, said marginal wales being composed of threads that are more rigid than said foundation threads; and (b) a row of coupling elements mounted on one of said webs remotely from said wale-free region.

2. A venting slide fastener stringer according to claim 1, said connecting thread being more rigid than said foundation threads.

3. A venting slide fastener stringer according to claim 1, each of said vent holes having substantially a size ranging from 0.5 mm×1 mm to 1 mm×2 mm.

4. A venting slide fastener stringer according to claim 1, each of said vent holes having substantially a size ranging from 0.5 mm×0.5 mm to 1 mm ×1 mm.

5. A slide fastener stringer comprising:

(a) a warp-knit stringer tape including a pair of longitudinal warp-knit webs spaced transversely from each other, with a longitudinal wale-free region therebetween, and having a pair of marginal wales, respectively, confronting each other across said wale-free region, and a thread interconnecting said webs and having portions laid only in said marginal wales and substantially parallel adjacent portions all extending transversely across said wale-free region and spaced longitudinally at an equal interval, thereby defining a plurality of substantially rectangular openings longitudinally in and along said wale-free region; and (b) a row of coupling elements mounted on one of said warp-knit webs remotely from said wale-free region.

6. A venting slide fastener stringer according to claim 1, including an additional connecting thread extending symmetrically with said first mentioned connecting thread across said wale-free region and having portions laid only in said marginal wales and substantially parallel portions spaced longitudinally of and extending transversely across said wale-free region along said first-mentioned substantially parallel portions, said connecting threads being laid across said wale-free region in patterns of 0–0/1–1/0–0/1–1/0–0/4–4/3–3/4–4/-3–3/14–and 4–4/3–3/4 –4/3–3/4/–4/0–0/1–1/0–0/1–1-0–0, respectively.

* * * * *